US005306396A

United States Patent [19]

Schlösser et al.

[11] Patent Number: 5,306,396

[45] Date of Patent: Apr. 26, 1994

[54] LEVELING DOOR

[75] Inventors: Rainer Schlösser, Essen; Paul Greiwe, Schermbeck, both of Fed. Rep. of Germany

[73] Assignee: Krupp Koppers GmbH, Essen, Fed. Rep. of Germany

[21] Appl. No.: 885,169

[22] Filed: May 18, 1992

[30] Foreign Application Priority Data

Jul. 6, 1991 [DE] Fed. Rep. of Germany ..... 4122492

[51] Int. Cl.[5] ..... C10B 25/06; C10B 25/16

[52] U.S. Cl. ..... 202/242; 202/248; 202/269

[58] Field of Search ..... 202/242, 248, 269

[56] References Cited

U.S. PATENT DOCUMENTS

| | | | |
|---|---|---|---|
| 2,442,391 | 6/1948 | Wilputte | 202/248 |
| 3,567,590 | 3/1971 | Reinfeld et al. | 202/248 |
| 3,990,950 | 11/1976 | Carr | 202/248 |
| 4,216,062 | 8/1980 | Kelly et al. | 202/248 |
| 4,427,494 | 1/1984 | Naevestad | 202/248 |
| 4,596,197 | 6/1986 | Kinzler | 202/248 |

FOREIGN PATENT DOCUMENTS

| | | | |
|---|---|---|---|
| 2426476 | 3/1975 | Fed. Rep. of Germany . | |
| 199789 | 8/1988 | Japan | 202/269 |

*Primary Examiner*—Joye L. Woodward
*Attorney, Agent, or Firm*—Michael J. Striker

[57] ABSTRACT

A leveling door for sealing a leveling opening of a coke oven door has a leveling door body, a diaphragm sheet mounted on the leveling door body at its side facing a leveling opening so as to cover the leveling opening, the diaphragm sheet having an edge and being provided on the edge with a circumferential sealing frame, a plurality of pressing elements acting on the sealing frame and distributed over a periphery of the sealing frame, a plurality of socket pins mounting the pressing element on the leveling door body, and an exchangeable heat protective screen arranged in front of the diaphragm sheet at a side facing the leveling opening.

8 Claims, 2 Drawing Sheets

LEVELING DOOR

BACKGROUND OF THE INVENTION

The present invention relates to a leveling door for sealing a leveling opening of a coke oven door, in which a flexible sealing element is pressed against a sealing surface surrounding the leveling opening.

During the end phase of the filling process of the oven chambers of coke oven batteries it is necessary to make uniform the height of the coal bulk in the respective filled oven chamber. This is performed with the aid of a leveling rod arranged on the coke ejecting machine. In order to introduce the leveling rod into the oven chamber and reciprocate it inside the chamber, the coke oven door is provided at its machine side in the region of the collecting chamber with a leveling opening which is closed by a leveling door when the leveling rod is withdrawn from the oven chamber. In order to prevent uncontrollable discharge of the gaseous products produced during the coking process, the leveling opening must be tightly closed with the leveling door.

In old leveling door constructions the required sealing was performed with the help of so called hammer strike strips. Hammer strike strips are mounted by clamping screws on the edges of the door body and brought to abutment against a sealing surface which surround the leveling openings by means of hammer strikes. This sealing principle which is identified as "iron-to-iron" requires expensive maintenance and is not always satisfactory with respect to its sealing properties. It operates only in proper conditions when on the one hand the sealing surfaces are retained very clean and on the other hand the temperature position of the seal provides the formation of sufficient quantity of the tar condensate on the sealing surfaces as a lock.

A leveling door is proposed in the German document DE-PS 2,426,476. It has a shell-shaped closing element composed of a material with springy properties. The flexible sealing edge of this closing element is pressed by a force acting in the middle against the sealing surface surrounding the leveling opening. The disadvantage of this construction is that on the one hand the production of such shall-shaped closing element is relatively expensive and on the other hand the force which acts only in the middle does not provide a sufficient adjustment to different conditions on the sealing edge or the sealing surface.

SUMMARY OF THE INVENTION

Accordingly, it is an object of the present invention to provide a leveling door which avoids the disadvantages of the prior art.

More particularly, it is an object of the present invention to provide a leveling door which has a high elastic sealing system operative for automatically compensating unevennesses of the sealing surface which surrounds the leveling opening, which can be expected during the operation of the coke oven battery.

It is therefore also an object of the present invention to provide such a leveling door which during an automatic actuation of opening and closing processes insures a permanent sealing of the leveling opening and also has a simple, inexpensive and easy to maintain construction.

In keeping with these objects and with others which will become apparent hereinafter, one feature of the present invention resides, briefly stated, in a leveling door which has a diaphragm sheet composed of high grade steel, mounted on the leveling door body at its side facing the leveling opening, and provided with a peripherally closed sealing frame on its edge; a spring-loaded pressing element which acts on said sealing frame and is distributed over the whole periphery of the sealing frame; socket pins which mount said pressing element on the leveling door body; and an exchangeable heat protective screen provided on the side facing the leveling opening in front of the diaphragm sheet.

When the leveling door is designed in accordance with the present invention, it avoids the disadvantages of the prior art and provides for the above mentioned highly advantageous results.

In accordance with another feature of the present invention, the sealing frame is assembled of four sealing strips which surround the diaphragm sheet from four sides and are welded with one another.

Still another feature of the present invention is that several pressing elements are assembled into a single unit and together mounted on the leveling door body.

Finally, still a further feature of the present invention is that the spring loading applied by the pressing element to the diaphragm sheet is limited by a corresponding adjustment of counternuts on the end of the plunger.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
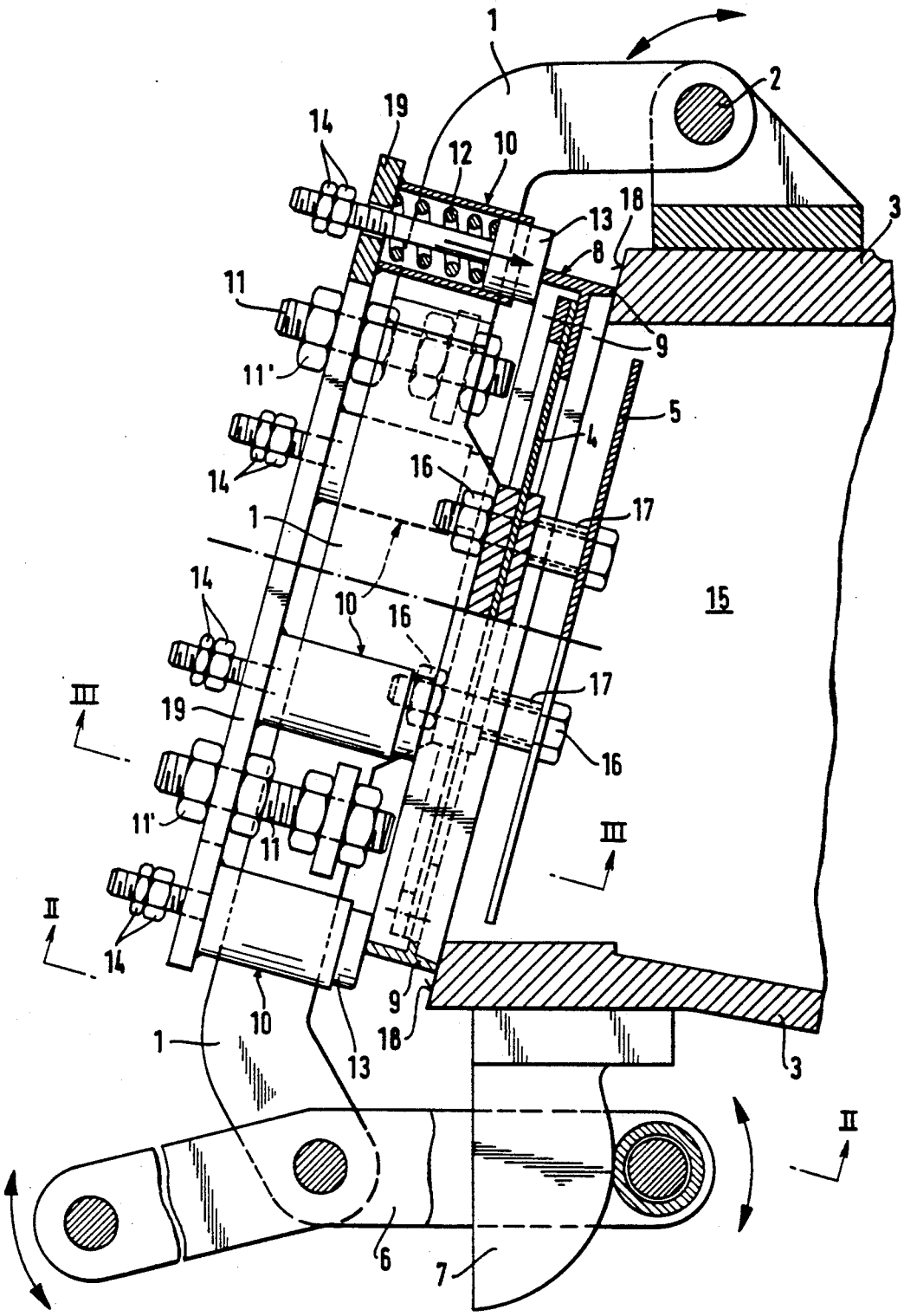
FIG. 1 of the drawing is a side view of the leveling door according to the present invention, in which the upper half of the door is shown in a longitudinal section.
Figure 2:
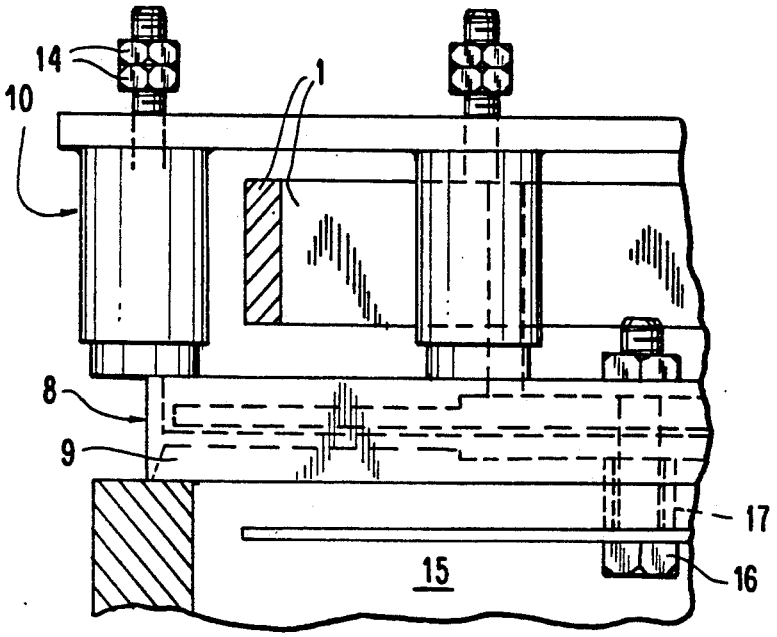
FIG. 2 is a view showing a section taken along the line II—II in FIG. 1.

A leveling door in accordance with the present invention has a leveling door body which is identified with reference numeral 1 and is composed of cast or forged iron. The leveling door body 1 is mounted on its upper end turnably on a coke oven door 3 by means of a hinge 2. It is of course to be understood that the leveling door body 1 in practice can be also mounted on the coke oven door body 3 so that it can be turnable downwardly or to the side.

A diaphragm sheet 4 is mounted on the leveling door body 1 at its side facing a leveling opening 15 and extends over the whole leveling opening 15. A heat protective screen 5 is also mounted on the leveling door body 1. The diaphragm sheet 4 is composed of high elastic high grade or alloyed steel and has a thickness of between 1.5 and 3.0 mm. The mounting of the diaphragm sheet 4 and the heat protecting screen 5 is performed in the shown embodiment in the middle of the leveling door body 1 by means of screw connections 16. Socket pins 17 for the screw connections 16 are arranged at a sufficient distance between the diaphragm sheet 4 and the heat protective sheet 5 so as not to affect adversely the elasticity of the diaphragm sheet 4. The above shown type of mounting of the diaphragm sheet 4 and the heat protective sheet 5 provide fast and easy exchange of both parts when needed.

Figure 3:
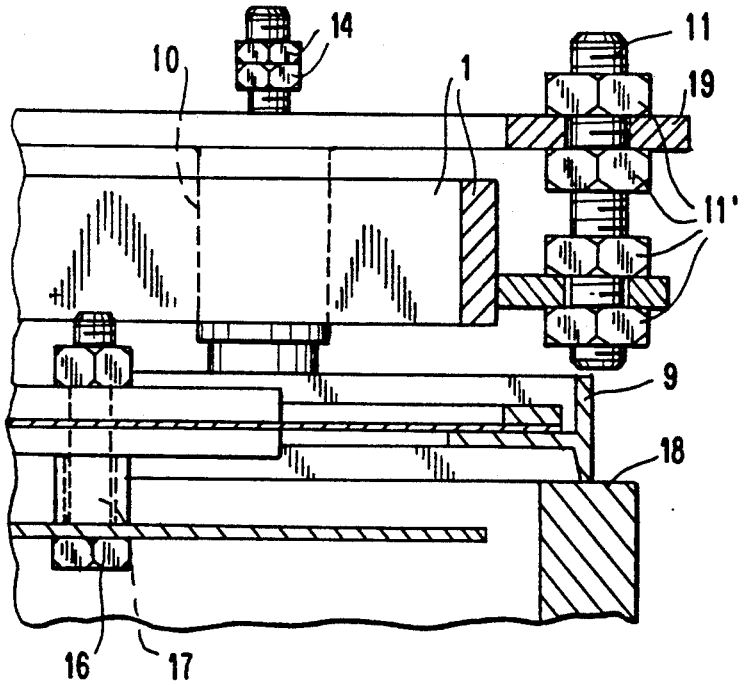
FIG. 3 is a view showing a section taken along the line III—III in FIG. 1.

A circumferential sealing frame 8 is arranged on the edge of the diaphragm sheet 4 and is screwed on the diaphragm sheet. The sealing frame 8 can be composed of four sealing strips 9 which surround the diaphragm sheet 4 at four sides. The sealing strips 9 can be welded with one another to from frame As can be seen from the drawings, the sealing strips 9 of the sealing frame 8 completely abut against a sealing surface 18 which surrounds the leveling opening 15 in the closed condition of the leveling door. Therefore the required sealing action is guaranteed. The pressing force which is needed for this purpose is provided by spring-loaded pressing elements 10 each having a plunger 13 and a spring element 12 and distributed over the whole periphery of the sealing frame 8. Several pressing elements 10 can be assembled to a unit by a connecting plate 19 which is mounted on the leveling door body 1 by socket pins 11. The socket pins 11 extend through the connecting plate 19 and the leveling door body 1 and are fixed on each of these parts by nuts 11' as shown in FIG. 3. This mounting system provides an accurate force adjustment of the pressing element 10 which act on the sealing strips 9 of the sealing frame 8 by their plungers 13 spring-loaded by the springs 12.

In order to prevent an eventual overstretching of the diaphragm sheet 4 by the pressing elements 10, the deviation of the diaphragm sheet 4 can be limited by a respective adjustment of counternuts 14 on the ends of the plunger 13 relative to the plate 19. The closed leveling door is locked in the shown embodiment by means of lever 6 which presses against a fastener 7 mounted on the coke oven door body 3. It is to be understood that also another locking mechanism can be used as well.

The inventive leveling door ensures under all conditions a good sealing from coke crude gas emission. The door in accordance with the present invention has a simple weight-saving and maintenance-favorable construction and provides for high operational safety.

It will be understood that each of the elements described above, or two or more together, may also find a useful application in other types of constructions differing from the types described above.

While the invention has been illustrated and described as embodied in a leveling door, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A leveling door for sealing a leveling opening of a coke oven door, comprising a leveling door body; a diaphragm sheet mounted on said leveling door body at its side facing a leveling opening so as to cover the leveling opening, said diaphragm sheet having an edge and being provided on said edge with a circumferential sealing frame; a plurality of pressing elements mounted on a connecting plate which is mounted on said leveling door body by socket pins so as to distribute said pressing elements over a periphery of said sealing frame and acting on said sealing frame; and an exchangeable heat protective screen arranged in front of said diaphragm sheet at a side facing said leveling opening.

2. A leveling as defined in claim 1, wherein said leveling door body is composed of a material selected from the group consisting of cast iron and forged iron.

3. A leveling door as defined in claim 1, wherein said diaphragm sheet has several sides, said sealing frame is composed of a plurality of sealing strips which surround said diaphragm sheet at said sides.

4. A leveling door as defined in claim 3, wherein said diaphragm sheet has four said sides, said sealing frame has four said sealing strips which surround said diaphragm sheet at said four sides.

5. A leveling door as defined in claim 1, wherein said pressing elements are assembled to form a unit, said pressing elements being formed so as to mount said unit on said leveling door body.

6. A leveling door as defined in claim 1; and further comprising spring means acting on said pressing elements so that said pressing elements spring load said diaphragm sheet; and means for limiting said spring loading of said diaphragm sheet by said pressing elements.

7. A leveling door as defined in claim 6, wherein each of said pressing elements includes a plunger having one end cooperating with said diaphragm sheet and another free end, and a spring which presses said one end of said plunger toward said diaphragm sheet, said limiting means including a counternut arranged on said another end of each of said pressing elements.

8. A leveling door as defined in claim 7; wherein said counternut is arranged so as to adjust a position to each of said plungers relative to said connecting plate.

* * * * *